US008408121B2

(12) United States Patent
Ferrari et al.

(10) Patent No.: US 8,408,121 B2
(45) Date of Patent: Apr. 2, 2013

(54) ROTATING CAROUSEL FOR ROTARY PRINTING MACHINES

(75) Inventors: Vittorio Ferrari, Reggio Emilia (IT); Milo Campioli, Reggio Emilia (IT)

(73) Assignee: Decomac-Sociata' a Responsabilita' Limitata, Reggio Emilia (RE) (IT)

( * ) Notice: Subject to any disclaimer, the term of this patent is extended or adjusted under 35 U.S.C. 154(b) by 366 days.

(21) Appl. No.: 12/815,720

(22) Filed: Jun. 15, 2010

(65) Prior Publication Data

US 2010/0313771 A1 Dec. 16, 2010

(30) Foreign Application Priority Data

Jun. 15, 2009 (IT) ..... RE2009A0057

(51) Int. Cl.
*B41F 17/08* (2006.01)

(52) U.S. Cl. ..... 101/38.1; 101/35; 101/115

(58) Field of Classification Search ..... 101/35, 101/38.1, 39, 115
See application file for complete search history.

(56) References Cited

U.S. PATENT DOCUMENTS

| | | | | |
|---|---|---|---|---|
| 5,154,119 | A | 10/1992 | Fuqua et al. | |
| 6,688,222 | B2 * | 2/2004 | Cattaruzza et al. | 101/212 |
| 6,766,735 | B1 | 7/2004 | Pankow | |
| 6,834,425 | B2 | 12/2004 | Budig et al. | |
| 2008/0264283 | A1 * | 10/2008 | Taig et al. | 101/375 |
| 2009/0020024 | A1 | 1/2009 | Campioli et al. | |

FOREIGN PATENT DOCUMENTS

| | | | |
|---|---|---|---|
| DE | 1107245 | B | 5/1961 |
| DE | 10204965 | C1 | 7/2003 |
| EP | 1637328 | A1 | 3/2006 |
| EP | 1764217 | A1 | 3/2007 |
| WO | WO2007090744 | A1 | 8/2007 |

* cited by examiner

*Primary Examiner* — Ren Yan
(74) *Attorney, Agent, or Firm* — Browdy and Neimark, PLLC

(57) ABSTRACT

A rotary printing machine for printing on containers, comprising a chuck-bearing carousel exhibiting an intermittent circular motion, being rotatably supported by a base element or casing, and being powered by an electric motor and integrated encoder, in which the electric motor comprises a stator coil supported by the casing and a rotor supported directly by the carousel.

5 Claims, 4 Drawing Sheets

ROTATING CAROUSEL FOR ROTARY PRINTING MACHINES

The present invention relates to printing machines for objects of generally cylindrical shape and utilizing offset, screen, flexographic, or similar printing systems, in which objects to be printed are rotated in contact with a print matrix.

Generally the matrix is located in a stationary printing station, while the chuck is one of a plurality of chucks supported radially in equidistant positions on a rotating platform known as a carousel and which advances in steps such as to successively present the chucks to the print station.

The present invention specifically regards the carousel and relative drive means.

In the prior art the carousel comprises a rotating plate fitted to a lower structure which is rotatably supported by a base element of the machine.

A suitable electric motor is connected to the structure using mechanical controlling means such as to adapt the times and rotation speeds to the requirements of the printing machine.

It is immediately evident that the need to provide drive transmission and control mechanisms represents a laborious, complicated, and expensive solution, and this is not the only drawback in the prior art.

A first serious disadvantage is the bulk and the limited durability and reliability of the mechanical means, which negatively conditions the design of the entire machine.

This type of printing machine generally exhibits an operating capacity of over four hundred cycles per minute, which means that the carousel must start and stop moving four hundred times per minute. The carousel is consequently subject to levels of acceleration that require high power levels, rigidity, and robustness, which are not always achievable using traditional systems of control and command, when the inertia of the rotating element is high.

Also unresolved are problems derived from a high moment of inertia of the rotating parts, which induces particularly high inertial forces as a consequence of the rotational velocity of the rotating parts and the extremely short movement and stop times required.

Many of these problems derive from the high number and weight of the parts driven in rotation, and from the fact that the various mechanical devices must guarantee very high and consistent positioning precision of the carousel at each stop position.

A final but equally serious problem of the prior art derives from the fact that the duration of the stop and movement stages of the carousel are inextricably linked, which means that if, for example, a user wants to extend the stop stage, it is inevitable that the movement stage will also be extended.

The aim of the invention is to provide a carousel that obviates the problems described above and comprises a reduced number of components compared to carousels of known type, also providing very high rigidity and a total absence of mechanical contact and consequently wear.

The aim of the invention is attained by a carousel exhibiting the characteristics described in the independent claims.

The dependent claims delineate further useful characteristics and improvements of the invention.

The carousel of the invention comprises a casing, enclosing an assembly of a stator coil and a rotor, controlled both in velocity and activation times by a control circuit comprising an encoder device entirely integrated into the structure.

The casing directly supports, on a suitable bearing, the motor rotor which faces onto the upper surface of the casing.

The rotating plate of the carousel is fitted directly to the motor rotor which bears peripherally-distributed permanent magnets, the rotating plate thus being supported by the same bearings that support the rotor.

The resulting assembly combines considerable constructional simplicity and an electric motor exhibiting a large diameter rotor capable of generating and absorbing high momentum.

The advantages and the constructional and functional characteristics of the invention better emerge in the detailed description made herein, which in the accompanying figures of the drawings illustrate a preferred embodiment provided by way of a non-limiting example.

Figure 1:
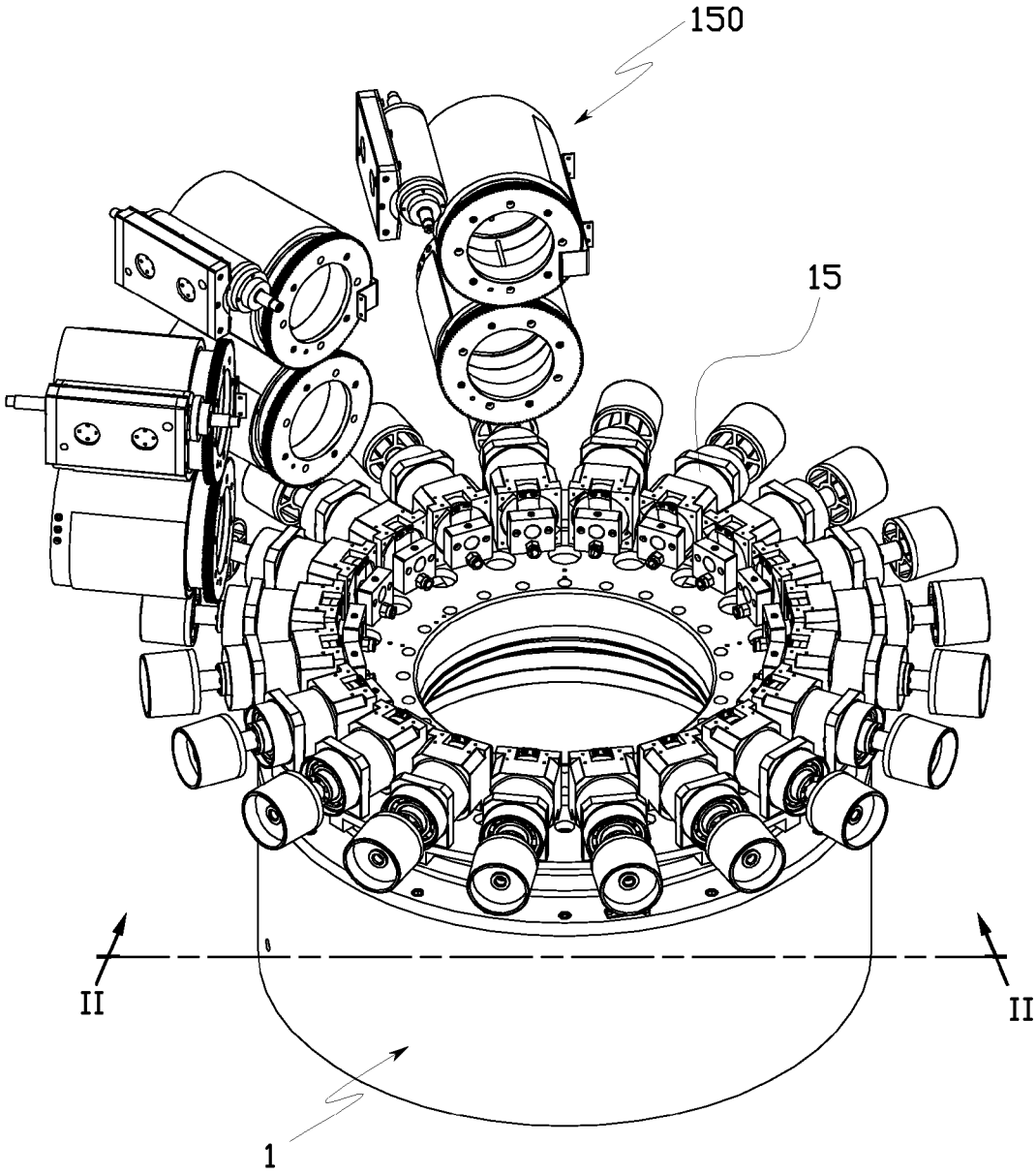
FIG. 1 is a perspective view of the machine of the invention.
Figure 2:
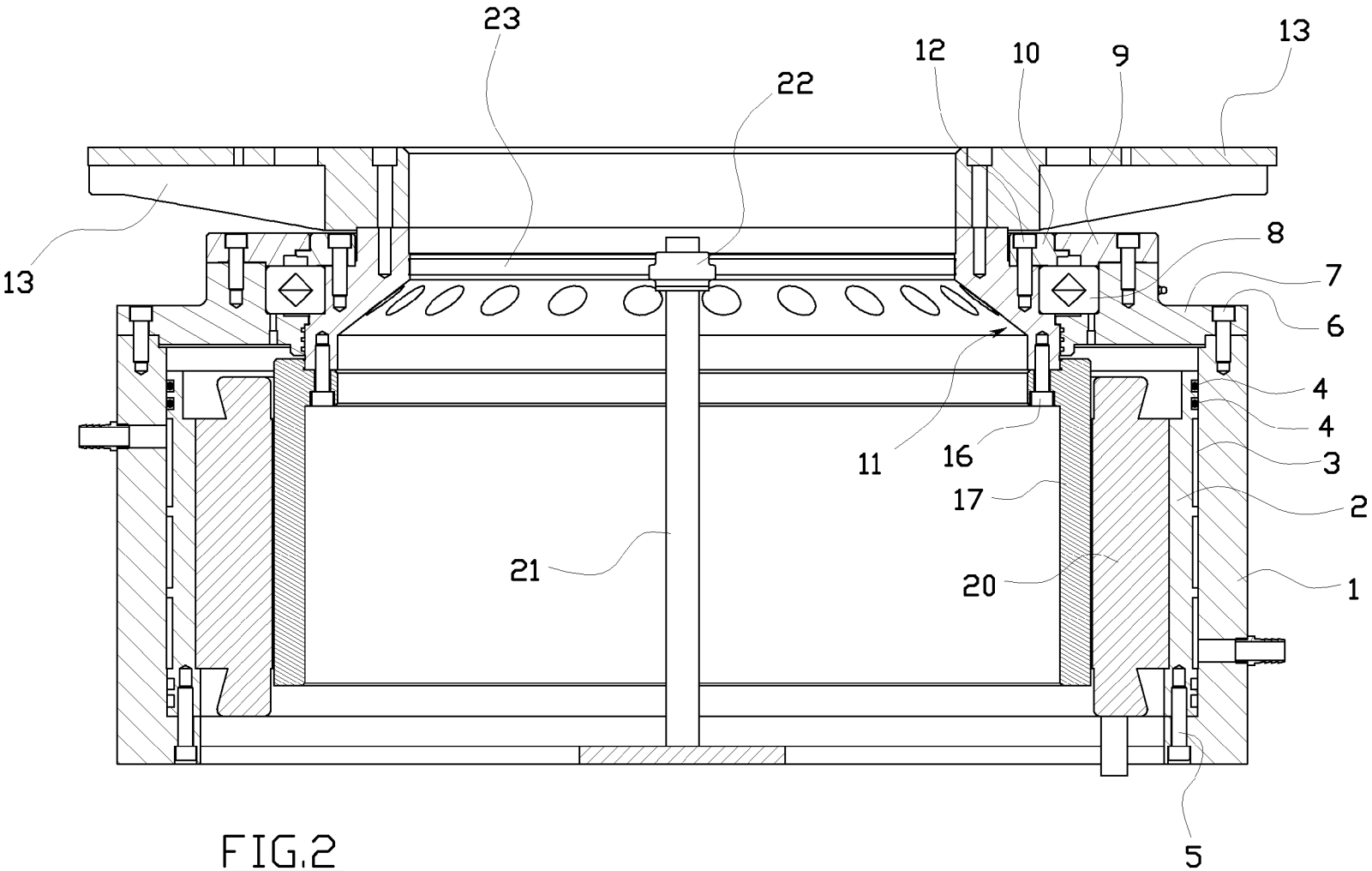
FIG. 2 is the cross-section II-II of FIG. 1.
Figure 3:
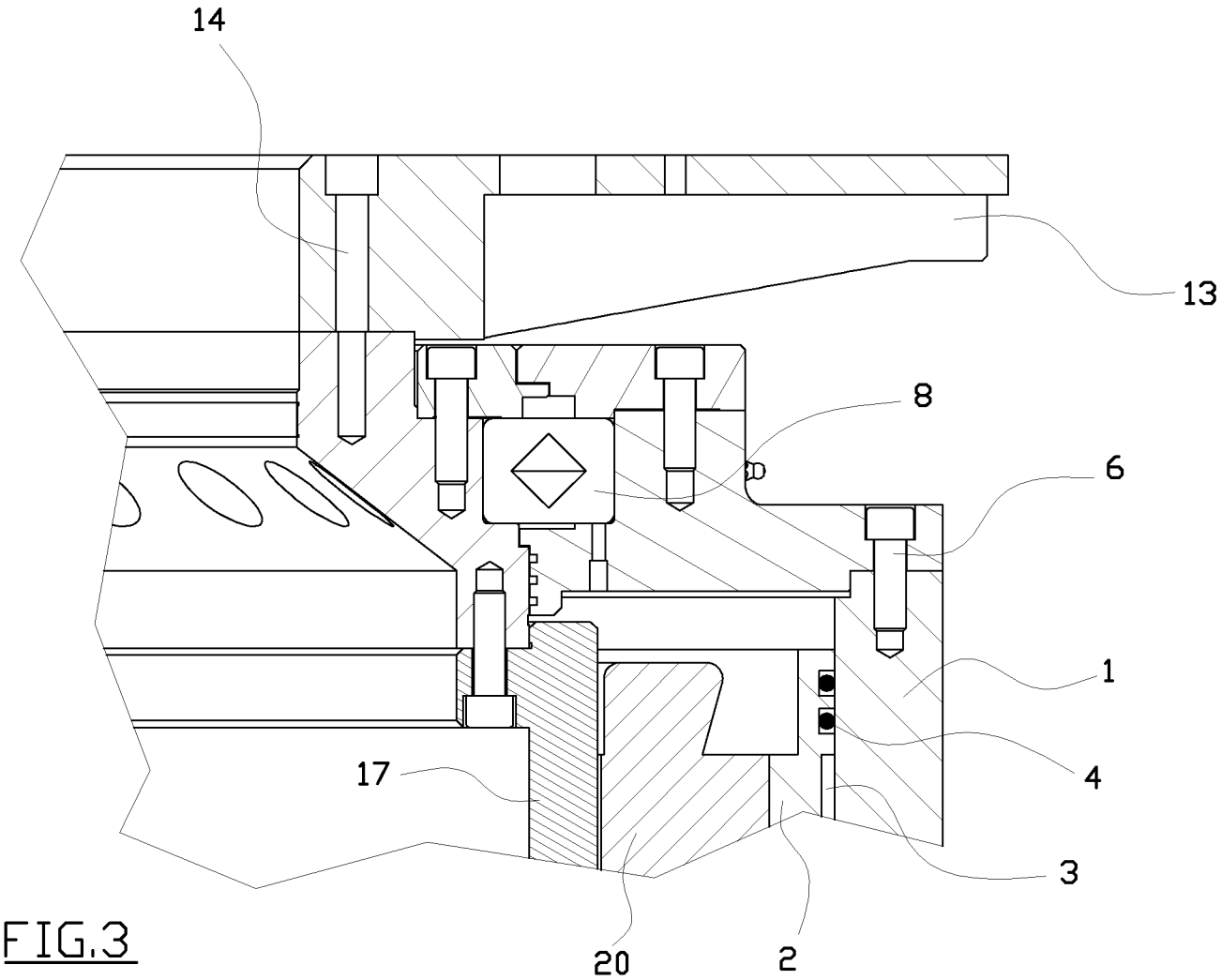
FIG. 3 is an enlarged detail of FIG. 2.

The figures show a machine casing 1, of cylindrical shape, housing a lining 2 comprising cooling ducts 3 and annular hydraulic sealing gaskets 4.

The carousel 1 peripherally supports the object-bearing chucks 15 supporting the objects to be printed-on and presents the said objects to the print stations 150.

The lining 2 is fitted to the casing 1 using a series of bolts 5 spaced around a lower circumference of the casing.

The lining 1 supports a first upper flange 7 in an upper position, fitted via a series of bolts 6 around a circumference of the casing, the flange 7 comprising a seating for a fixed ring of a bearing, schematically illustrated and labelled by 8.

A second upper flange 9 is fitted to the first flange 7 and acts on the fixed ring of the bearing 8 such as to retain the ring in position.

The internal rotating ring of the bearing 8 is fitted to the body of the rotor.

The body of the rotor comprises a third upper flange 10, restingly in contact with the rotating ring of the bearing 8 and supporting an intermediate body 11 fastened circumferentially thereto with bolts 12; the intermediate body 11 comprises a seating for the mobile ring of the bearing 8.

Means for hydraulic sealing and cooling ducts 3 are inserted between the first upper flange 8 and the intermediate body 11, schematically denoted by 4.

The intermediate body 11 superiorly supports the rotating plate 13 of the machine, on which the chucks 15 supporting the objects to be printed are fitted.

The intermediate body 11 inferiorly supports, via a circumferential series of bolts 16, a cylinder 17 on which a series of permanent magnets are externally fitted (not illustrated). The cylinder 17 comprises the rotor of an electric motor the stator coil 20 of which is fitted to the inside of the lining 2.

An upright element 21 projects upwards at the centre of the casing 1, which element 21 superiorly supports a head 22 of an encoder device, a ring 23 of the encoder device being fitted to the inside of the intermediate body 11.

In the illustrated example the cylinder 17 is made of resin, and the stator coil 20 exhibits the characteristics of a brushless motor of known type designed for intermittent movements.

The thus-realised electric motor is controlled using a control circuit of known type.

Figure 4:
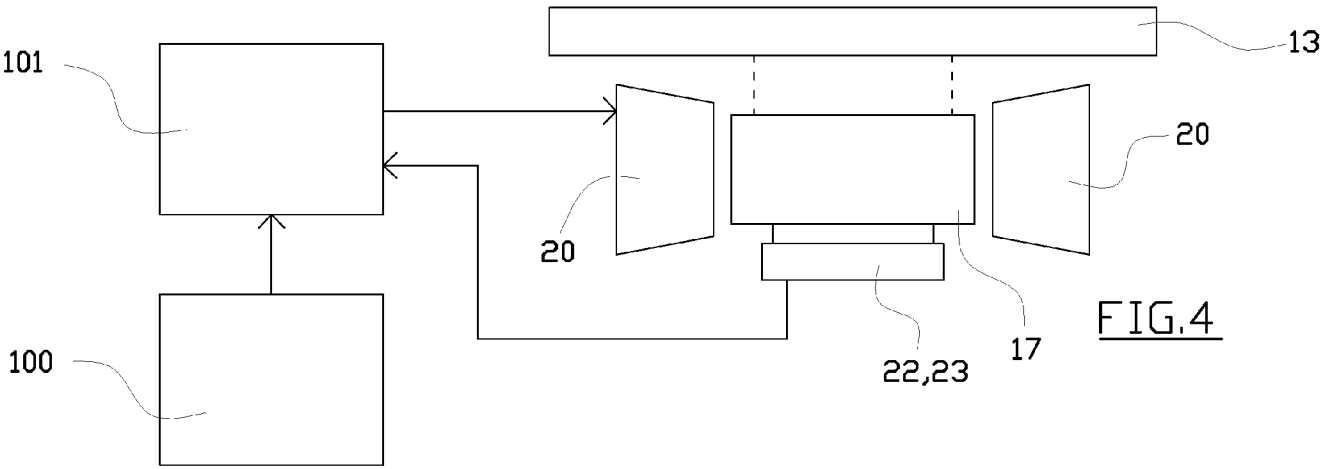
FIG. 4 is an electromechanical diagram of the invention.

The control circuit, illustrated schematically in FIG. 4, comprises a control logic unit 100 which governs the movement and stop stages of the carousel by transmitting signals to the drive circuit 101 of the electric motor, which in turn transmits other signals to the stator coil 20 of the motor.

The circuit 101 in turn receives signals from the above-described encoder (22, 23).

Figure 5:
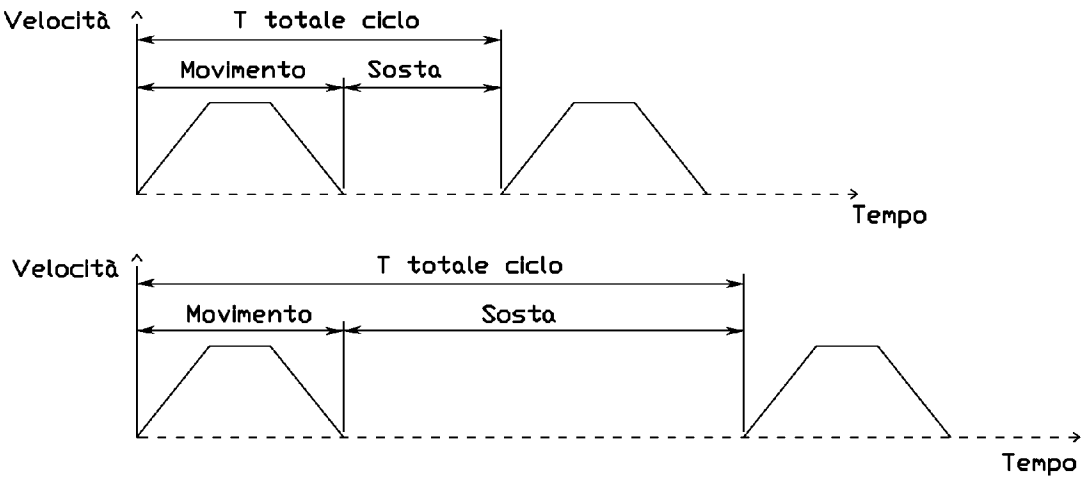
FIG. 5 is a diagram of the movement and stop stages of the carousel in two different operating conditions.

The mechanisms described above make it possible to attain activation cycles for the carousel (FIG. 4 and FIG. 5) in which identical movement stages can be combined with different stop stages.

The invention is not limited to the example illustrated and variants and improvements could be made without its forsaking the ambit of the invention of the following claims.

The invention claimed is:

1. A rotary printing machine for printing on containers, comprising a chuck-bearing carousel exhibiting an intermittent circular motion, being rotatably supported by a base element or casing, and being powered by an electric motor, wherein the electric motor is controlled both in velocity and activation times by a control circuit comprising an integrated encoder device and comprises a stator coil supported by the casing and a rotor supported directly by the carousel, and a vertical upright element projects upwards from the centre of the casing, an upper portion of which vertical upright element supports a head of the encoder device, a ring of which encoder device is solidly mounted on the carousel.

2. The rotary printing machine of claim 1, wherein the casing sealedly internally contains a lining comprising cooling ducts and hydraulic sealing gaskets, the stator coil being directly supported by the lining.

3. The rotary printing machine of claim 1, wherein the encoder integrated with the rotor transmits signals directly to said control circuit of the motor, which also receives signals from a logic circuit governing movement and stop stages of the carousel.

4. The rotary printing machine of claim 3, wherein the movement and stop stages of the carousel are independent of each other.

5. A rotary printing machine for printing on containers, comprising:

a chuck-bearing carousel configured to move in an intermittent circular motion, a base element or casing rotatably supporting the carousel, an electric motor for supplying power to the carousel, a control circuit for controlling velocity and activation times of the electric motor, the control circuit comprising an integrated encoder device, a stator coil supported by the casing and a rotor supported directly by the carousel, the integrated encoder device having a head and a ring connected to the head, and a vertical upright element projecting upwardly from a centre of the base element or casing, the vertical upright element having an upper portion supporting the head of the encoder device, and wherein the ring is directly mounted on the carousel.

* * * * *